US005716151A

United States Patent [19]

Satake

[11] Patent Number: 5,716,151

[45] Date of Patent: Feb. 10, 1998

[54] COATING TOOL

[75] Inventor: Atsunori Satake, Tano-gun, Japan

[73] Assignee: Mitsubishi Pencil Kabushiki Kaisha, Tokyo, Japan

[21] Appl. No.: 585,201

[22] Filed: Jan. 11, 1996

[30] Foreign Application Priority Data

Jan. 11, 1995 [JP] Japan ..... 7-002613

[51] Int. Cl.[6] ..... B43K 9/00; B43K 7/00

[52] U.S. Cl. ..... 401/188 A; 401/187; 401/213; 401/214

[58] Field of Search ..... 401/187, 188 R, 401/188 A, 214, 213; 92/168

[56] References Cited

U.S. PATENT DOCUMENTS

| | | | |
|---|---|---|---|
| 1,319,556 | 10/1919 | Baker | 401/188 A X |
| 2,027,656 | 1/1936 | Tassle | 401/187 |
| 3,333,512 | 8/1967 | Parsons | 92/168 X |
| 3,343,460 | 9/1967 | Jones | 92/168 |
| 5,362,169 | 11/1994 | Hamamoto et al. | 401/188 A X |
| 5,421,664 | 6/1995 | Okamoto | 401/188 A X |
| 5,462,379 | 10/1995 | Masumoto et al. | 401/188 A X |
| 5,468,082 | 11/1995 | Hori | 401/188 A X |
| 5,542,771 | 8/1996 | Masumoto | 401/188 A X |

FOREIGN PATENT DOCUMENTS

| | | |
|---|---|---|
| 1044198 | 11/1953 | France . |
| 5-58090 | 3/1993 | Japan . |
| 6-16088 | 3/1994 | Japan . |
| 2 241 881 A | 9/1991 | United Kingdom . |

*Primary Examiner*—Steven A. Bratlie
*Attorney, Agent, or Firm*—Darby & Darby

[57] ABSTRACT

A coating tool (12) comprises a coating tool body (2) having a liquid storage portion (2*a*) for storing a coating liquid, and a cap (10) detachably fitted and mounted on the coating tool body to be in tight contact with it. In the course of mounting the cap (10), the volume of a sealed space (A) formed in the cap (10) is decreased to supply air to the main barrel (2*a*), thereby pressurizing the interior of the main barrel (2*a*). At least one of an inner surface (10*b*1) of the cap (10) and an outer surface of a mouthpiece (2*b*) which are brought into tight contact with each other in the mounting operation of the cap (10) is coated with a sealing agent (16). In the coating tool for applying a correction liquid or the like, the ability to pressurize the interior of the liquid storage portion (2*a*) can be improved without complicating the structure in the cap (10), and the cap can be attached and detached smoothly.

16 Claims, 6 Drawing Sheets

COATING TOOL

BACKGROUND OF THE INVENTION (1) Field of the Invention

The present invention relates to a coating tool for coating a surface with a correction liquid, an ink, a cosmetic liquid, a glue, or the like and, more particularly, to a coating tool in which the volume of a sealed space formed in a cap is decreased in the course of mounting the cap to increase the pressure in a liquid storage portion.

(2) Description of the Related Art

As a coating tool for coating with a coating liquid, e.g., a correction liquid, a cap pressure scheme is conventionally known. According to this scheme, as described in, e.g., Japanese Patent Application Laid-open No. Hei 5-58090, when a cap is mounted, the interior of a main body barrel serving as a liquid storage portion is pressurized. When this coating tool is to be used, a spherical coating member provided to the tip of the tool is only pushed against a surface to open a discharge port, so that the coating liquid flows out due to a pressure difference between the inside and outside of the main barrel.

In a coating tool of this type, generally, air is supplied into the main barrel in the course of mounting the cap by decreasing the volume of the sealed space formed in the cap.

Accordingly, in the conventional coating tool, the sealing properties of the sealed space largely influence the pressurizing ability. Hence, high dimensional precision is required in machining the inner surface of the cap and the outer surface of the coating tool body that are to be in tight contact with each other. At the same time, if a small gap is present between the inner and outer surfaces due to dimensional variations in machining, or if distortions, flaws, or the like are present on the inner and outer surfaces, even slightly, the pressurizing ability is decreased considerably. Inversely, when the gap between the inner and outer surfaces is excessively small, the cap is mounted too tightly. Then, the inner and outer surfaces may be rubbed against each other and damaged, or abnormal noise may be generated during the mounting operation of the cap.

SUMMARY OF THE INVENTION

The present invention has been achieved in view of the problems of the above conventional coating tool, and has as an object to provide a coating tool in which the ability to pressurize the interior of a liquid storage portion is improved without complicating the structure in a cap and the cap can be attached and detached smoothly.

In order to achieve the above object, according to the present invention, there is provided a coating tool comprising a coating tool body having a liquid storage portion for storing a coating liquid, and a cap detachably fitted and mounted on the coating tool body to be in tight contact with the coating tool body, characterized in that the liquid storage portion is supplied with air by decreasing a volume of a sealed space formed in the cap in the course of mounting the cap, thereby to be pressurized and, at least one of a fitting surface of the cap and a fitting surface of the coating tool body which are brought into tight contact with each other in mounting the cap is coated with a sealing agent.

According to the present invention, at least one of the fitting surface of a cap and the fitting surface of a coating tool body that are brought into tight contact with each other in mounting the cap is coated with a sealing agent. Thus, even if a gap is present between the fitting surfaces of the cap and coating tool body due to the machining variations, or even if distortions, flaws, or the like, are present on the fitting surfaces, air passages that can be formed between the two fitting surfaces by the gap or the like are closed with the sealing agent in the course of mounting the cap. Hence, according to the present invention, the machining variations and the like are absorbed only by applying a sealing agent to an existing coating tool, so that a highly airtigt sealed space is ensured. Therefore, the ability to pressurize the interior of the liquid storage portion can be improved without complicating the structure in a cap.

Even if the gap between the two fitting surfaces is small, the sealing agent serves as a lubricant, so that the cap can be mounted on the coating tool body smoothly. Thus, the fitting surfaces can be prevented from being rubbed against each other and damaged, and generation of abnormal noise during the mounting operation of the cap can be prevented.

BRIEF DESCRIPTION OF THE DRAWINGS

The invention will now be described with reference to the accompanying drawings in which.

DETAILED DESCRIPTION OF THE PREFERRED EMBODIMENTS

The present invention provides a coating tool comprising a coating tool body having a liquid storage portion for storing a coating liquid, and a cap detachably fitted and mounted on the coating tool body to be in tight contact with it. In the course of mounting the cap, the volume of a sealed space formed in the cap is decreased to supply air to the liquid storage portion, and the interior of the liquid storage portion is pressurized thereby. At least one of the fitting surface of the cap and the fitting surface of the coating tool body which are brought into tight contact with each other in mounting the cap is coated with a sealing agent, so that an airtight sealed space is ensured.

As a sealing agent of the present invention, one having a predetermined viscosity is selected as required from almost nonvolatile fluid materials which are capable of improving an airtight sealed space and have a viscosity in a selection range of 10 to 100,000 cSt in accordance with the application of a coating tool and the type of a coating liquid.

As a sealing agent, a silicone oil having a wide selection range of a viscosity is preferable and, for example, dimethyl silicone oil, methyl phenyl silicone oil, or the like is suitable.

In addition to a silicone oil, for example, an aliphatic hydrocarbon such as liquid paraffin having 16 or more carbon atoms, a higher aliphatic alcohol, a higher fatty acid, a fatty amide or the like may be employed. A phosphate ester such as tributyl phosphate, a phthalate ester such as dimethyl phthalate, an aliphatic monobasic acid ester such as butyl oleate, an aliphatic dibasic acid ester such as dibutyl adipate, a dihydric alcohol ester such as diethylene glycol dibenzoate, an oxyacid ester such as methyl acetylricinoleate, or chlorinated biphenyl may be employed. Fats and oils or a lubricant, e.g., natural fats and oils such as soybean oil, may also be employed.

EMBODIMENTS

The present invention will be described in detail with reference to preferred embodiments in conjunction with the accompanying drawings.

Figure 1:
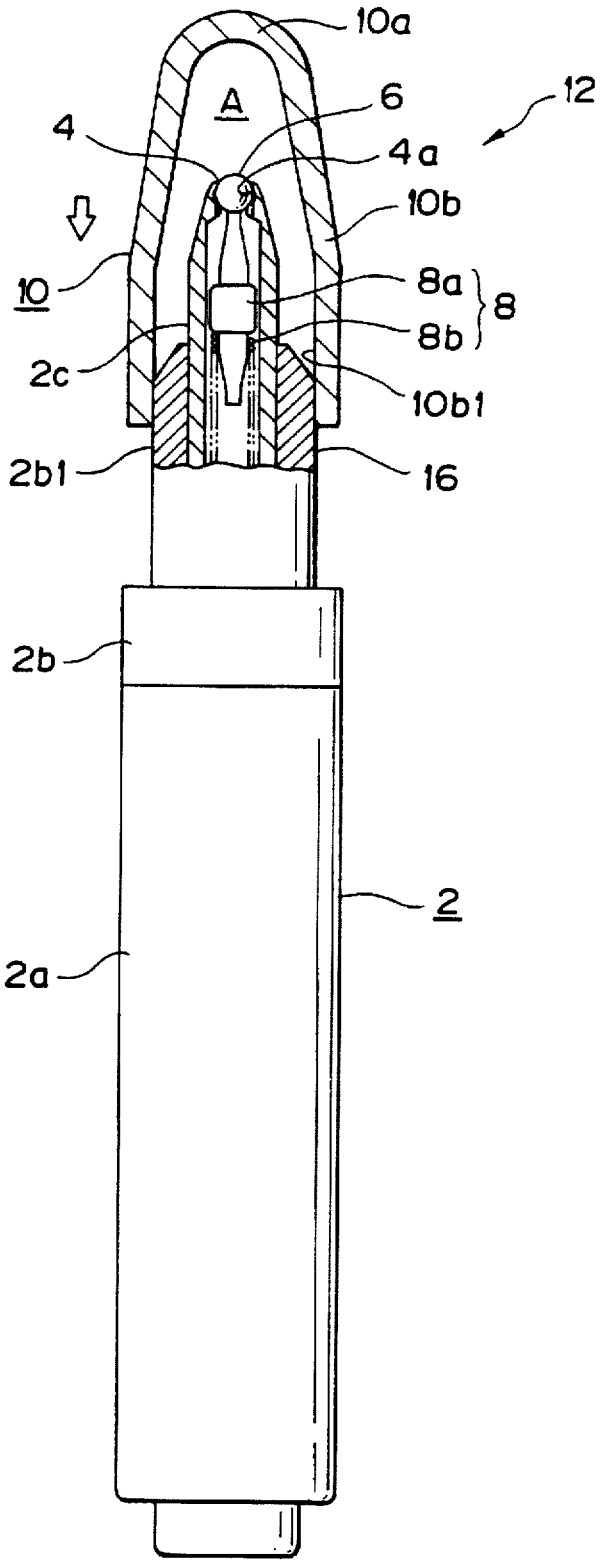
FIG. 1 is a partially sectional view showing a coating tool according to the first embodiment of the present invention.

A coating tool 12 according to the first embodiment has, as shown in FIG. 1, a coating tool body 2, a discharge port 4, a spherical coating member 6, a forcing means 8, and a cap 10. The coating tool body 2 has a main barrel (corresponding to a liquid storage portion) 2*a* storing a coating liquid. The discharge port 4 is open to the distal end of the coating tool body 2, and the coating liquid in the main barrel 2*a* flows out through the discharge port 4. The spherical coating member 6 is partly exposed to the outside through the discharge port 4 and is brought into contact with and separated from an inner edge portion 4*a* of the discharge port 4, thus closing and opening the discharge port 4. The forcing means 8 forces the spherical coating member 6 forward. The cap 10 is detachably mounted on the coating tool body 2 to be in tight contact with the coating tool body 2, such that it encloses the distal end portion of the coating tool body 2. In the course of mounting the cap 10, the volume of a sealed space A formed in the cap 10 is decreased, so that air is supplied into the main barrel 2*a*, thereby pressurizing the interior of the main barrel 2*a*.

The arrangements of the respective portions of the coating tool 12 of the first embodiment will be described. As shown in FIG. 1, the coating tool body 2 is mainly constituted by a bottomed cylindrical main barrel 2*a*, a mouthpiece 2*b* connected and fixed to the open end portion of the main barrel 2*a*, and a tip 2*c* pressed into the front portion of the mouthpiece 2*b* and holding a spherical coating member 6 at its distal end portion. A forcing means 8 is constituted by a push rod 8*a* and a compression coil spring 8*b*. The front end face of the push rod 8*a* is abutted against the spherical coating member 6. The compression coil spring 8*b* has a front end engaged with a stepped portion at nearly the central portion, in the longitudinal direction, of the push rod 8*a*, and a rear end supported in the tip 2*c*. The forcing means 8 constantly forces the spherical coating member 6 in such a direction that the spherical coating member 6 is abutted against the inner edge portion 4*a* of the discharge port 4.

The cap 10 has a substantially cylindrical shape in which only its rear end is open and its distal end portion 10*a* is slightly tapered. An inner surface (an example of the fitting surface of the cap) 10*b*1 at the rear portion of a wall 10*b* of the cap 10 has a size nearly equal to or slightly smaller than that of an outer surface (an example of the fitting surface of the coating tool body 2) 2*b*1 of the mouthpiece 2*b*. The cap 10 is fitted on the mouthpiece 2*b* to be in tight contact with it. When the cap 10 is fitted on the mouthpiece 2*b*, a sealed space A surrounded by the inner surface of the cap 10, the outer surface of the tip 2*c*, and the tapered outer surface of the front end portion of the mouthpiece 2*b* is formed in the cap 10.

Figure 2:
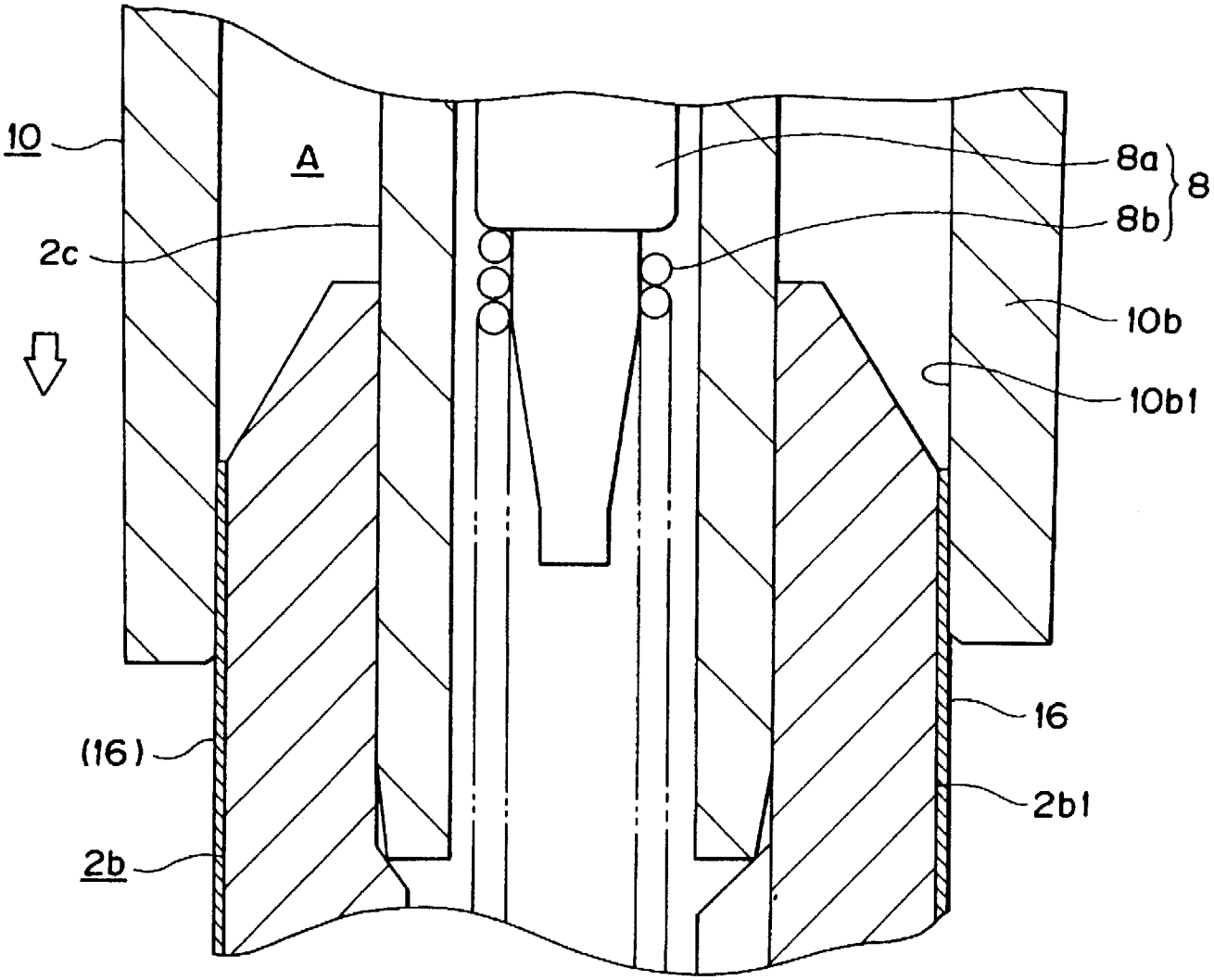
FIG. 2 is an enlarged sectional view of the main part of the first embodiment.

In the first embodiment, as shown in FIG. 2, the outer surface 2*b*1 of the mouthpiece 2*b*, which is brought into tight contact with the inner surface 10*b*1 of the cap 10 in the course of mounting the cap 10, is coated with a sealing agent 16. The sealing agent 16 may be applied to only the inner surface 10*b*1 of the cap 10 or the outer surface 2*b*1 of the mouthpiece 2*b*, or to both of them. In the first embodiment, the sealing agent 16 is applied to the outer surface 2*b*1 of the mouthpiece 2*b* because the outer surface is easily accessible.

The sealing agent 16 is present between the inner surface 10*b*1 and the outer surface 2*b*1 in the course of mounting the cap 10, and improves the airtightness of the sealed space A.

In the first embodiment having the above arrangement, the interior of the main barrel 2*a* is pressurized in the following manner. When a user places and mounts the cap 10 such that its inner surface 10*b*1 is brought into tight contact with the outer surface 2*b*1 of the mouthpiece 2*b*, the sealed space A is formed in the cap 10. At this time, as the outer surface 2*b*1 of the mouthpiece 2*b* has been coated with the sealing agent 16, even if a Gap is present between the inner surface 10*b*1 of the cap 10 and the outer surface 2*b*1 of the mouthpiece 2*b* due to machining variations, or even if distortions, flaws, or the like are present on the inner surface 10*b*1 or the outer surface 2*b*1 , air leakage passages that can be formed between the two fitting surfaces by the gap or the like is closed with the sealing agent 16 in the course of mounting the cap 10.

As the mounting operation of the cap 10 progresses, the internal pressure of the sealed space A is increased effectively while the high airtightness of the sealed space A is maintained. When the internal pressure of the sealed space A reaches or exceeds a predetermined degree, the spherical coating member 6 and the push rod 8*a* are moved backward against the force of the coil spring 8*b*. Due to this backward movement, the spherical coating member 6 is separated from the inner edge portion 4*a* of the discharge port 4 to open the discharge port 4. Thus, air in the sealed space A enters a storage portion in the main barrel 2*a* through the open discharge port 4, thereby pressurizing the interior of the storage portion.

According to the first embodiment, the machining variations and the like are absorbed only by coating the outer surface 2*b*1 of the mouthpiece 2*b* with the sealing agent 16, so that the highly airtight sealed space A is ensured. Therefore, the ability to pressurize the interior of the main barrel 2*a* can be improved without complicating the structure in the cap 10.

Even if the gap between the inner surface 10*b*1 of the cap 10 and the outer surface 2*b*1 of the mouthpiece 2*b* is small, the sealing agent 16 also serves as a lubricant, so that the cap 10 can be mounted on the coating tool body 2 smoothly. Thus, the inner surface 10*b*1 and the outer surface 2*b*1 can be prevented from being rubbed against each other and damaged, and generation of abnormal noise during the mounting operation of the cap 10 can be prevented.

Figure 3:
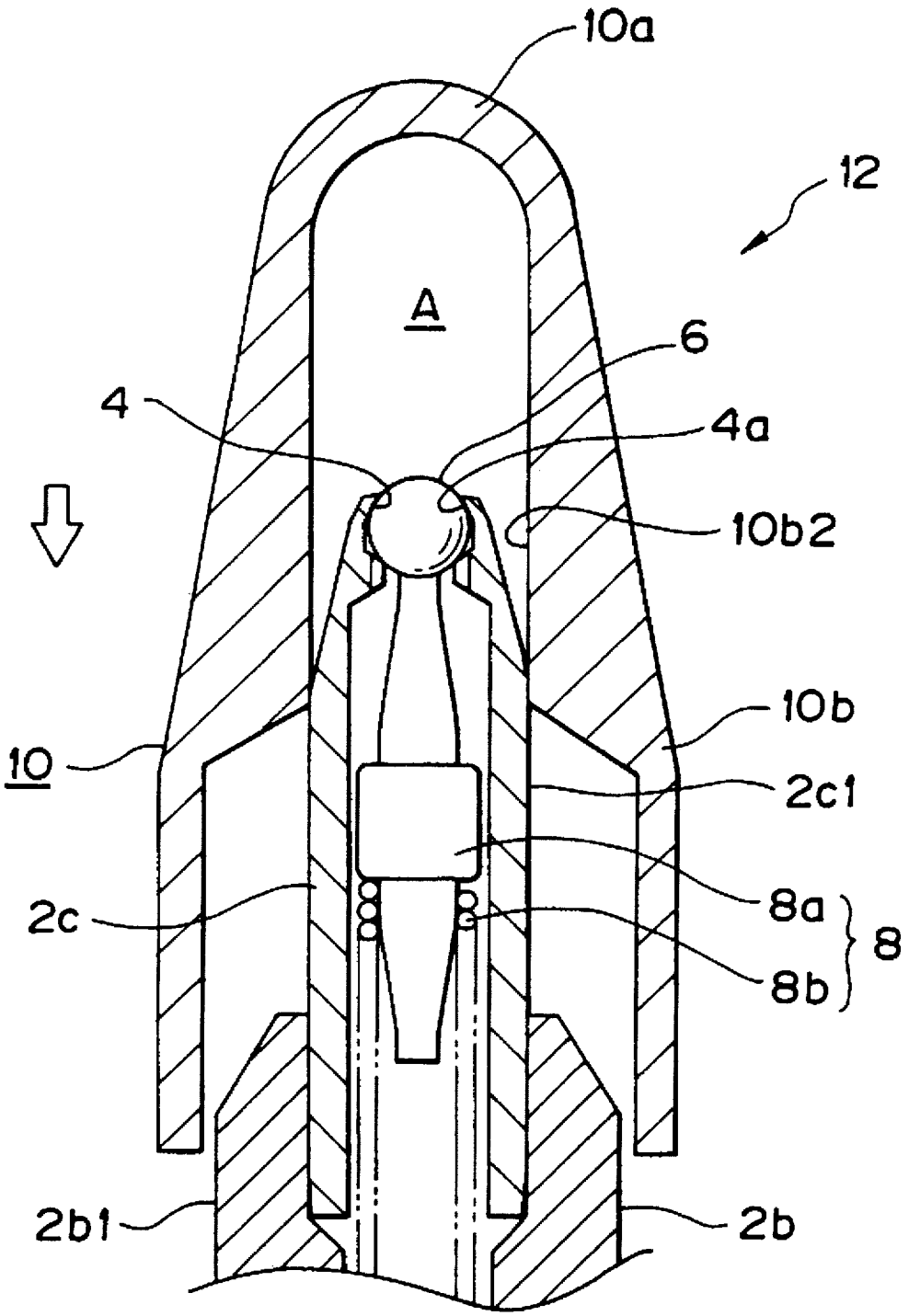
FIG. 3 is an enlarged sectional view of the distal end portion of a coating tool according to the second embodiment.

The second embodiment will be described. FIG. 3 is an enlarged sectional view of the distal end portion of a coating tool according to the second embodiment.

As shown in FIG. 3, a coating tool 12 of the second embodiment is obtained by modifying the basic arrangement of the first embodiment such that a cap 10 and a tip 2*c* are fitted with each other to be in tight contact, so that a sealed space A is formed in the cap 10.

In the cap 10 according to the second embodiment, the substantial half portion of its wall 10*b* on the distal end side is formed thicker than the proximal end side of cap 10. The size of the inner diameter of this thick portion is set to be nearly equal to or slightly smaller than the outer diameter of the tip 2*c*. At least one of the inner surface 10*b*2 and the outer surface 2*c*1 of the tip 2*c* is coated with a sealing agent (not shown in the drawing) identical to that described above. Thus, the pressurizing effect in the course of mounting the cap 10 and attachability/detachability of the cap 10 can be improved in the same manner as in the first embodiment. Particularly, in this case, the inner surface 10b2 serving as the fitting surface of the cap 10 is formed at a position deep within the cap 10. As this inner surface 10b2 is difficult to precisely machine, the sealing agent capable of absorbing the variations in machining precision largely contributes to an improvement in pressurizing effect.

Figure 4:
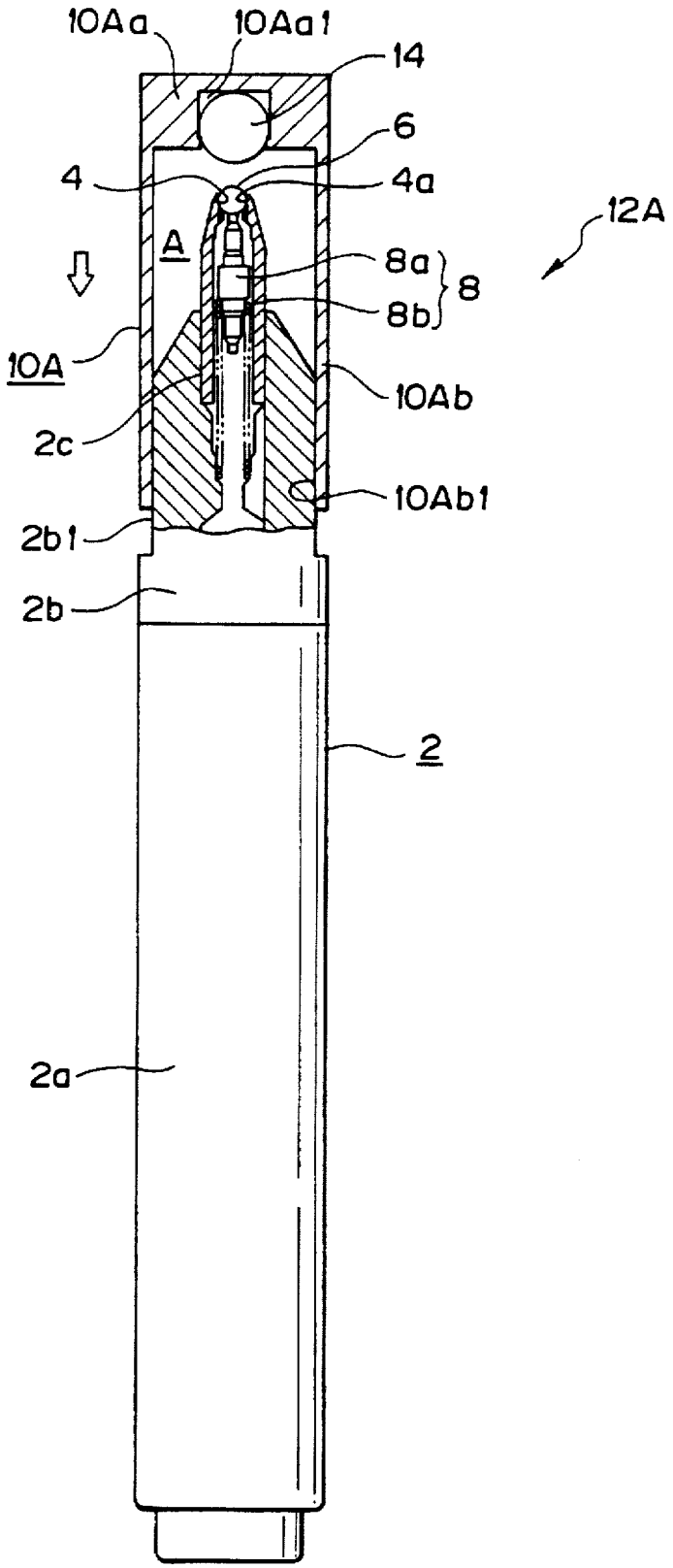
FIG. 4 is a partially sectional view of a coating tool according to the third embodiment.

The third embodiment will be described. FIG. 4 is a partially sectional view showing a coating tool according to the third embodiment.

As shown in FIG. 4, a coating tool 12A according to the third embodiment has a coating tool body 2, a discharge port 4, a spherical coating member 6, a forcing means 8, which are constituted in the same manner as in the first embodiment, and a bottomed cylindrical cap 10A. The cap 10A is detachably mounted on the coating tool body 2 to be in tight contact with the coating tool body 2, such that it encloses the distal end portion of the coating tool body 2. An elastic spherical rubber member 14 is disposed in the cap 10A so as to oppose the spherical coating member 6 at the time of mounting the cap 10A. In the course of mounting the cap 10A, the spherical rubber member 14, which is in elastic contact with the distal end portion of the spherical coating member 6, moves the spherical coating member 6 backward to open the discharge port 4. When the mounting operation of the cap 10A is completed, the spherical rubber member 14 covers the discharge port 4 to close it.

A bottom portion 10Aa of the closed end portion of the cap 10A is formed to be thicker than a wall 10Ab of the cap 10A, and an accommodating portion 10Aa1 for accommodating and holding the spherical rubber member 14 is formed at nearly the central portion of the bottom portion 10Aa. A plurality of pawls projecting inward are formed on the open edge of the accommodating portion 10Aa1. The spherical rubber member 14 is held in the accommodating portion 10Aa1 with these plurality of pawls such that it partly projects toward the open end slightly. An inner surface 10Ab1 of the wall 10Ab of the cap 10A is formed to have a size nearly equal to or slightly smaller than that of an outer surface 2b1 of a mouthpiece 2b, so that the cap 10A is fitted on the mouthpiece 2b to be in tight contact with it.

In the third embodiment, at least one of the inner surface 10Ab1 of the cap 10A and the outer surface 2b1 of the mouthpiece 2b is coated with a sealing agent.

According to the third embodiment having the above arrangement, when a user places and mounts the cap 10 such that its inner surface 10Ab1 is brought into tight contact with the outer surface 2b1 of the mouthpiece 2b, the internal pressure of a sealed space A is increased. At the same time, the spherical rubber member 14 is dented and deformed to be brought into elastic contact with the distal end portion of the spherical coating member 6, and moves the spherical coating member 6 and a push rod 8a backward against the force of a coil spring 8b. Along with this backward movement, the spherical coating member 6 is separated from the inner edge portion 4a of the discharge port 4 to open the discharge port 4. Thus, air in the sealed space A enters the storage portion in a main barrel 2a through the open discharge port 4, thereby pressurizing the interior of the storage portion easily.

Therefore, in the third embodiment, the pressurizing effect of the spherical rubber member 14 and the effect of improving the airtightness of the sealed space A with the sealing agent in the course of mounting the cap are combined to further improve the ability to pressurize the interior of the main barrel 2a.

Figure 5:
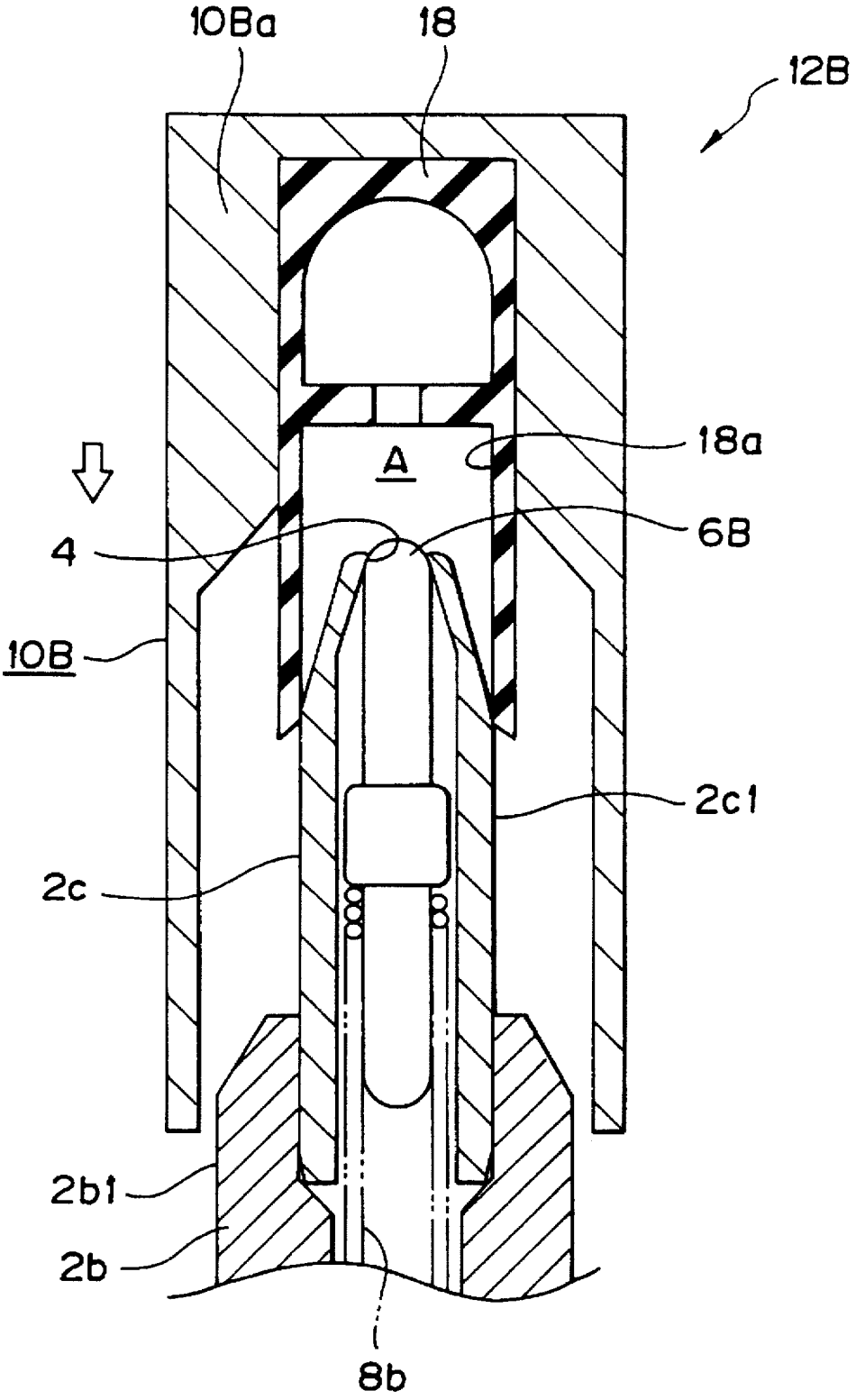
FIG. 5 is an enlarged sectional view of the distal end portion of a coating tool according to the fourth embodiment.

The fourth embodiment will be described. FIG. 5 is an enlarged sectional view of the distal end portion of a coating tool according to the fourth embodiment.

In the fourth embodiment, a valve opening member 18 having a substantially H-shaped section is disposed in a bottom portion 10Ba of a cap 10B. In the mounting operation of the cap 10B, a rod-shaped coating member 6B is temporarily moved backward by the valve opening member 18 to open a discharge port 4, so that air enters in a main barrel 2b. When the mounting operation of the cap 10B is completed, the valve opening member 18 is separated from the coating member 6B, so that the discharge port 4 is closed with the coating member 6B again.

In the fourth embodiment, when an inner surface 18a of the valve opening member 18 is fitted with an outer surface 2c1 of the distal end portion of a tip 2c to be in tight contact with it, a sealed space A is formed in the valve opening member 18. At least one of the inner surface 18a of the valve opening member 18 and the outer surface 2c1 of the tip 2c is coated with a sealing agent identical to that described above.

In the fourth embodiment, the structure in the cap 10B is complicated. However, considering that the airtightness of the sealed space A is improved by the sealing agent, the present invention can also be applied to a coating tool of this type.

The technical scope of the present invention also encompasses coating a member which is incorporated in a cap besides a cap body, with a sealing agent, as in this fourth embodiment in which the inner surface 18a of the valve opening member 18 additionally provided in the cap 10B is coated with the sealing agent. More specifically, the cap-side fitting surface of the present invention refers to the fitting surface of a cap body, or the fitting surface of an additional member incorporated in the cap body, each of which is brought into tight contact with the fitting surface of the coating tool body.

Figure 6:
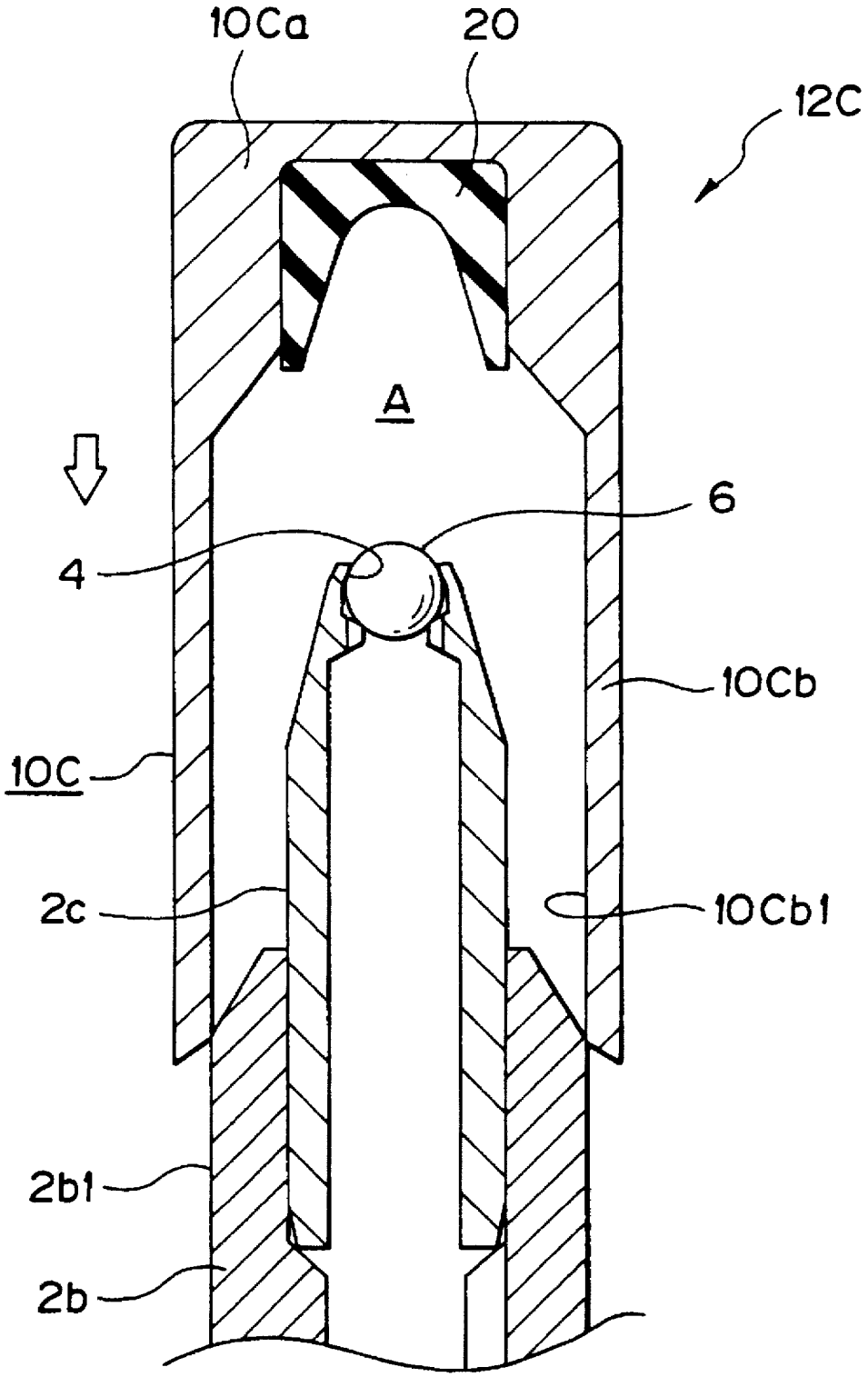
FIG. 6 is an enlarged sectional view of the distal end portion of a coating tool according to the fifth embodiment.

The fifth embodiment will be described. FIG. 6 is an enlarged sectional view of the distal end portion of a coating tool according to the fifth embodiment.

Each of the first to fourth embodiments has a forcing means for forcing a coating member forward. In contrast to this, the fifth embodiment provides a coating tool 12C in which a spherical coating member 6 is held at the distal end of a tip 2c to be movable horizontally and vertically. When the coating tool is not in use, a coating liquid is dried and solidified in the gap between the spherical coating member 6 and a discharge port 4, thereby closing the discharge port 4.

A cap 10C has a bottomed cylindrical shape. A bottom portion 10Ca of the cap 10C is formed to be thicker than a wall 10Cb of the cap 10C. An elastic member 20 which closes the discharge port 4 when the mounting operation of the cap 10C is completed, is fitted in the bottom portion 10Ca.

An inner surface 10Cb1 of the wall 10Cb of the cap 10C is fitted on an outer surface 2b1 of a mouthpiece 2b to be in tight contact with it. At least one of the inner surface 10Cb1 and the outer surface 2b1 is coated with a sealing agent identical to that described above.

In this manner, even in the coating tool 12C not having a means for forcing the spherical coating member 6 forward, a sealing agent improves an airtight sealed space A, thus improving the pressurizing ability. Considering this fact, an effect exerted by the sealing agent is very large.

The above first to fifth embodiments merely describe the preferred embodiments of the coating tool of the present invention, and the technical scope of the present invention is not limited by these embodiments.

For example, in the first to fifth embodiments, the present invention is applied to a case wherein a cap is applied to the discharge port at the distal end of a coating tool body. However, the present invention can similarly be applied to a coating tool in which the interior of a main barrel can be pressurized in the course of fitting a cap to the tail end portion of the main barrel, as in a coating tool disclosed in Utility Model Application Laid-open No. Hei 6-16088. In this case, if at least one of the fitting surface of the tail end portion of the main barrel and the fitting surface of the cap is coated with the sealing agent, an excellent pressurizing effect can be obtained.

As has been described above, according to the present invention, in the coating tool for applying a correction liquid or the like, the ability to pressurize the interior of the liquid storage portion can be improved without complicating the structure in the cap, and the cap can be attached and detached smoothly.

What is claimed is:

1. A coating tool comprising a coating tool body having a liquid storage portion for storing a coating liquid, and a cap detachably fitted and mounted on said coating tool body to be in tight contact with said coating tool body, characterized in that said liquid storage portion is supplied with air by decreasing a volume of a sealed space formed in said cap in the course of mounting said cap, thereby to be pressurized, and at least one of a fitting surface of said cap and a fitting surface of said coating tool which are brought into tight contact with each other in the mounting operation of said cap is coated with a viscous sealing agent.

2. A coating tool according to claim 1 including a mouthpiece connected and fixed to said coating tool body, and a tip pressed into said mouthpiece and holding a coating member, so that said mouthpiece and said cap are fitted with each other.

3. A coating tool according to claim 2 wherein a spherical rubber member is disposed in said cap so as to oppose said coating member when said cap is mounted.

4. A coating tool according to claim 1 including a mouthpiece connected and fixed to said coating tool body, and a tip pressed into said mouthpiece and holding a coating member, so that said tip and said cap are fitted with each other.

5. A coating tool according to claim 1 including a tip and a valve opening member wherein said a valve opening member, which moves a coating member backward to open a coating liquid discharge port, is disposed in said cap, so that said valve opening member and said tip are fitted with each other.

6. A coating tool according to claim 1 wherein a sealing agent is a silicone oil.

7. A coating tool according to claim 6 wherein the silicone oil is dimethyl silicone oil or methyl phenyl silicone oil.

8. A coating tool according to claim 1 wherein the sealing agent is an aliphatic hydrocarbon.

9. A coating tool according to claim 8 wherein the aliphatic hydrocarbon is a liquid paraffin having 16 or more carbon atoms, a higher aliphatic alcohol, a higher fatty acid or a fatty acid amide.

10. A coating tool according to claim 1 wherein the sealing agent is a phosphate ester, a phthalate ester, an aliphatic dibasic acid ester, a dihydric alcohol ester, an oxyacid ester or a chlorinated biphenyl.

11. A coating tool according to claim 10 wherein the phosphate ester is tributyl phosphate.

12. A coating tool according to claim 10 wherein the phthalate ester is dimethyl phthalate.

13. A coating tool according to claim 10 wherein the aliphatic dibasic acid ester is dibutyl adipate.

14. A coating tool according to claim 10 wherein the dihydric alcohol ester is diethylene glycol dibenzoate.

15. A coating tool according to claim 10 wherein the oxyacid ester is methyl acetylricinoleate.

16. A coating tool according to claim 1 wherein the sealing agent has a viscosity in a range of 10 to 100,000 cSt.

* * * * *